US005403408A

United States Patent [19]

Krause et al.

[11] Patent Number: 5,403,408

[45] Date of Patent: Apr. 4, 1995

[54] NON-UNIAXIAL PERMANENT MAGNET MATERIAL

[75] Inventors: Robert F. Krause, Valparaiso, Ind.; John Keem, Bloomfield Hills, Mich.; Jun S. Im, Sterling Heights, Mich.; Su Cronogue, Troy, Mich.

[73] Assignee: Inland Steel Company, Chicago, Ill.

[21] Appl. No.: 963,095

[22] Filed: Oct. 19, 1992

[51] Int. Cl.[6] ..... H01F 1/053

[52] U.S. Cl. ..... 148/302; 420/83; 420/121

[58] Field of Search ..... 148/302; 420/83, 121

[56] References Cited

U.S. PATENT DOCUMENTS

| | | | |
|---|---|---|---|
| 4,374,665 | 2/1983 | Koon | 75/123 E |
| 4,402,770 | 9/1983 | Koon | 148/31.57 |
| 4,409,043 | 10/1983 | Koon | 148/403 |
| 4,496,395 | 1/1985 | Croat | 75/123 E |
| 4,533,408 | 8/1985 | Koon | 148/103 |
| 4,715,891 | 12/1987 | Ovshinsky et al. | 75/0.5 BA |
| 4,753,675 | 6/1988 | Ovshinsky et al. | 75/0.5 AA |
| 4,765,848 | 8/1988 | Mohri et al. | 148/302 |
| 4,770,723 | 9/1988 | Sagawa et al. | 148/302 |
| 4,802,931 | 2/1989 | Croat | 148/302 |
| 4,851,058 | 7/1989 | Croat | 148/302 |
| 4,867,785 | 9/1989 | Keem et al. | 75/0.5 C |
| 4,881,985 | 11/1989 | Brewer et al. | 148/103 |
| 4,935,074 | 6/1990 | DeMooij et al. | 148/302 |
| 4,971,637 | 11/1990 | Ohashi et al. | 148/301 |
| 5,022,939 | 6/1991 | Yajima et al. | 148/302 |
| 5,049,208 | 9/1991 | Yajima et al. | 148/302 |
| 5,071,493 | 12/1991 | Mizoguchi et al. | 148/302 |
| 5,089,065 | 2/1992 | Hamano et al. | 148/302 |
| 5,116,434 | 5/1992 | Keem et al. | 148/101 |

FOREIGN PATENT DOCUMENTS

| | | | |
|---|---|---|---|
| 0195219 | 9/1986 | European Pat. Off. . | |
| 0242187 | 10/1987 | European Pat. Off. | 148/302 |
| 0493019 | 7/1992 | European Pat. Off. . | |
| 3928389 | 3/1992 | Germany . | |

OTHER PUBLICATIONS

Cullity, B. D., *Elements of X-Ray Diffraction*, Addison-Wesley Publishing, 1956, p. 32.

Cullity, B. D., *Introduction to Magnetic Materials*, Addison-Wesley Publishing, 1972, p. 594.

Koon, N. C. et al., "Composition Dependence of the . . . Alloys", *IEEE Transactions on Magnetics*, vol. Mag 18, No. 6, Nov. 1982.

Buschow, K. H. J. et al., "Properties of Metastable . . . System", *Journal of the Less-Common Metals*, vol. 125, 1986, pp. 135–146.

Coehoorn, R. et al., "Meltspun Permanent Magnet . . . Phase", *J. of Magnetism and Magnetic Materials*, vol. 80, 1989, pp. 101–104.

*CRC Handbook of Chemistry and Physics*, 71st ed., 1990, pp. 4–160.

Schultz, L. et al., "Permanent Magnets by Mechanical Alloying", *J. of Applied Physics*, vol. 70, No. 10, 15 Nov. 1991, pp. 6339–6344.

Official Gazette of the U.S. Patent Office, Jul. 12, 1988, p. 815, (U.S. Pat. No. 4,756,775–now withdrawn).

*Primary Examiner*—George Wyszomierski

*Attorney, Agent, or Firm*—Marshall, O'Toole, Gerstein, Murray & Borun

[57] ABSTRACT

A permanent magnet material having the formula, in atomic %:

$$TM_{(84.3-w-z)}RE_{(3.0+w)}B_{(12.7+z)},$$

wherein $-3.3 \leqq z < 3.3$ and $-2.0 \leqq w < 2.0$; or $$TM_{(89.8-x-y)}RE_{(3.5+y)}B_{(6.7+x)},$$

wherein $-2.5 \leqq y < 2.5$ and $-2.7 \leqq x \leqq 2.7$; or $$TM_{(96.5-q-r)}RE_{(1+q)}B_{(2.5+r)},$$

wherein $-1.5 \leqq r \leqq 1.5$ and $0 \leqq q < 6.5-r$; and wherein TM is a transition metal, RE is a rare earth metal, and B is boron or a combination of boron and carbon. The permanent magnet materials include at least weight percent non-uniaxial material and possess a coercivity of at least 1,000 Oersteds.

42 Claims, 3 Drawing Sheets

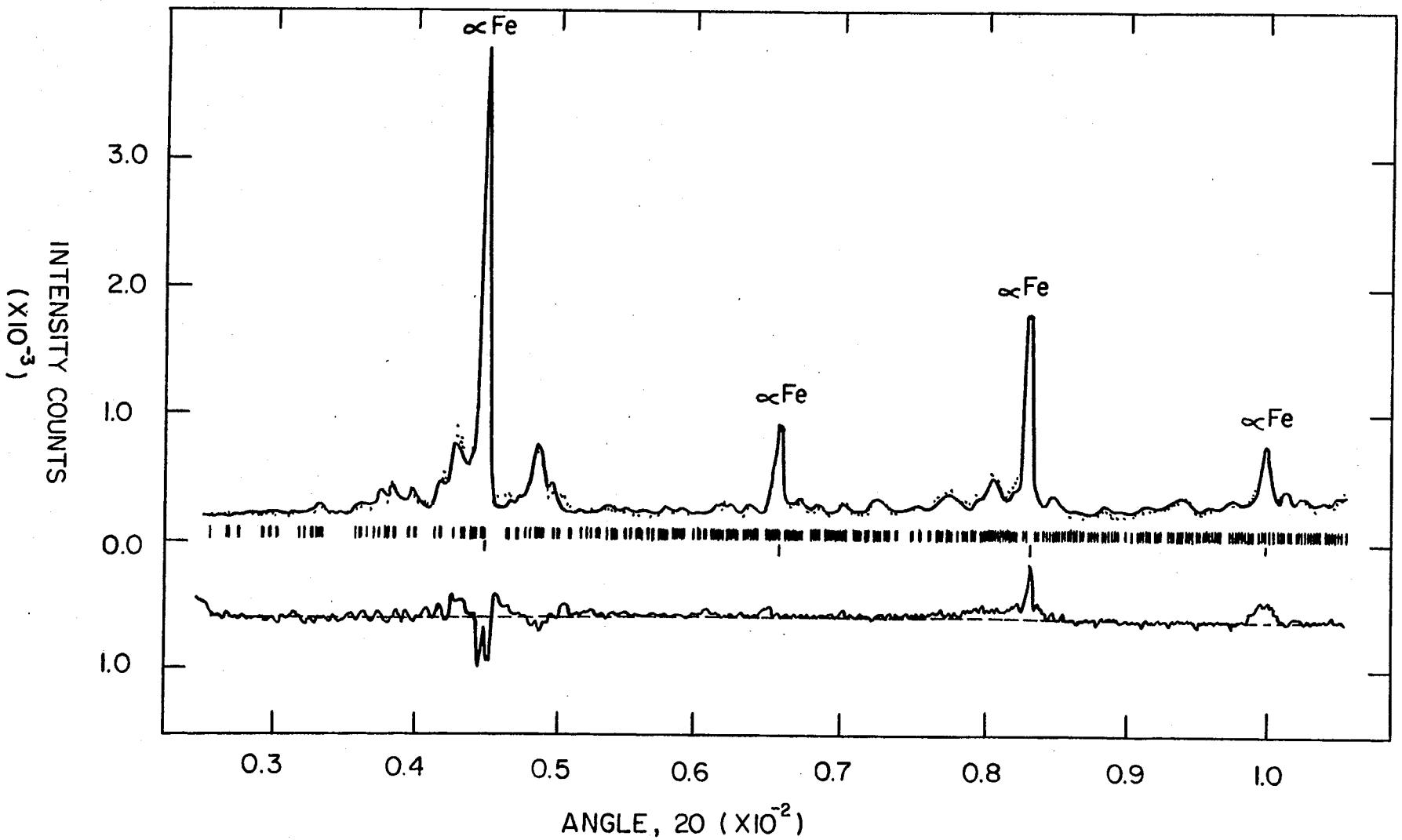
∝Fe
∝Fe
∝Fe
∝Fe
3.0
2.0
1.0
0.0
1.0
INTENSITY COUNTS
(X10$^{-3}$)
0.3
0.4
0.5
0.6
0.7
0.8
0.9
1.0
ANGLE, 2θ (X10$^{-2}$)

NON-UNIAXIAL PERMANENT MAGNET MATERIAL

FIELD OF THE INVENTION

The present invention is directed generally to a permanent magnet material and to a permanent magnet comprising the permanent magnet material. In particular, the present invention is directed to a permanent magnet material comprising a transition metal, a rare earth metal and boron component.

BACKGROUND OF THE INVENTION

Permanent magnets are an important component in electric and electronic articles ranging from domestic electrical appliances to peripheral terminal devices of mainframe computers. Because of the trend towards miniaturization of high efficiency electric and electronic equipment, there is an increasing demand for strong permanent magnets that can be mass produced easily and economically. Accordingly, investigators continually are searching for relatively inexpensive and high performance permanent magnet materials. High performance permanent magnet materials generally exhibit relatively high magnetic properties, such as coercivity, remanence and maximum magnetic energy product.

A coercivity of about 1,000 Oe is the minimum required for a permanent magnet. Coercivity is a measure of the relative ease of magnetizing and demagnetizing a magnet material. A low coercivity is advantageous because a magnet material can be magnetized easily. However, a low coercivity is disadvantageous because the magnetized magnet material also can be demagnetized easily. Accordingly, a permanent magnet material having a high coercivity is preferred.

Remanence is the degree of magnetization retained by a magnet material after removing the applied field that magnetizes the magnet material. For example, a remanence of about 8,000 G (Gauss) is considered the state of the art for noninteractive, isotropic transition metal (TM)rare earth metal (RE)-boron (B) magnetic materials having an atomic proportional formula of $RE_2TM_{14}B_1$. The maximum magnetic energy product ($BH_{max}$) is another measurement of magnetic strength. The highest theoretical $BH_{max}$ for perfectly aligned (anisotropic) magnetic materials is 64 MGOe (megaGaussOersteds). For unaligned (isotropic) materials, the highest theoretical $BH_{max}$ is 16 MGOe. For unaligned materials, the highest practical value for $BH_{max}$ is about 14.2 MGOe, and a typical $BH_{max}$ value is about 12 MGOe.

Magnetic materials having high magnetic properties are called "hard"; whereas magnetic materials having low magnetic properties are called "soft". Metallic alloys used as magnetic materials can be either hard or soft. Presently, a wide variety of hard magnetic materials (also termed permanent magnetic materials) are known and used in permanent magnets. However, every known permanent magnetic material which possesses high magnetic properties also has a high cost. A permanent magnet material having a reasonable cost is suitable for merely some applications, but is unsuitable for other applications.

The highest performance permanent magnets are manufactured from intermetallic compounds or alloys comprising (1) a rare earth metal, and (2) a transition metal, such as samarium-cobalt alloys, like $SmCo_5$, or similar alloys. These alloys possess sufficiently high magnetic properties for use in almost every application. However, because such alloys have the disadvantage of including a high percentage of very expensive metals, like cobalt, they are unsuitable for mass producing low cost magnets. In addition, alloys like samarium-cobalt alloys require a very complicated processing procedure to achieve maximum performance. A third disadvantage of these alloys is that the alloys exhibit a high coercivity over only a limited compositional range, thereby inherently limiting the ability of an investigator to alter other magnetic properties of the alloys, such as saturation magnetization, by changing the proportions of ingredients.

A magnet material that does not include a rare earth metal typically exhibits a substantially lower coercivity than samarium-cobalt and related alloys. The various forms of ALNICO, for example, exhibit a coercivity of about 600 to about 1400 Oe. A coercivity in this range is too low for many applications because the magnet material is demagnetized too easily. ALNICO alloys also have the disadvantage of including a relatively large amount of cobalt, which is expensive.

Ferrites, which contain iron oxides, also are used extensively as permanent magnet materials. Various classes of ferrite are available very cheaply, but ferrites typically have a low remanence and possess a moderate coercivity. The main advantage of ferrites therefore is a very low cost, which makes the mass production of ferrite-containing permanent magnets practical.

Because of the disadvantages exhibited by prior permanent magnet materials, investigators sought a permanent magnet material that outperforms the ferrites, and that is less expensive than the samarium-cobalt alloys. One such class of permanent magnet materials comprises one or more transition metals, one or more rare earth metals, and boron. Prior transition metal-rare earth metal-boron (TM—RE—B) alloys predominantly included a "2-14-1" phase, i.e., $RE_2TM_{14}B_1$, wherein the subscripts denote the atomic proportions of the components (alternatively expressed as $TM_{82}RE_{12}B_6$, wherein the subscripts denote the atomic percentages (atomic %) of the components). The $RE_2TM_{14}B_1$ alloy has a uniaxial crystal structure, i.e., a single easy axis of magnetization. Conventionally, investigators have maintained that a permanent magnet material must be crystallographically uniaxial in order to exhibit permanent magnetic properties.

To date, non-uniaxial TM—RE—B alloys have not been used in permanent magnets because the non-uniaxial TM—RE—B alloys exhibited a coercivity of less than 1,000 Oe. Investigators have been unable to provide a TM—RE—B alloy of sufficiently high coercivity (i.e., at least 1,000 Oe) when the magnet material includes too large a fraction of non-uniaxial material. Therefore, prior TM—RE—B alloys with substantial non-uniaxial material (e.g., more than 10 weight %) possessed no intrinsic permanent magnetic properties. Surprisingly and unexpectedly, a permanent magnet material of the present invention, including at least 10%, and typically at least 40%, by weight non-uniaxial material, exhibits sufficiently high magnetic properties for use in a permanent magnet.

Therefore, prior permanent magnets could be manufactured from 1) the highly effective but very expensive samarium-cobalt alloys, which limit mass production of the permanent magnets because of raw material cost, or 2) the ferrites, which are economical but do not exhibit sufficient magnetic properties for many permanent magnet applications. In addition, between these extremes there were permanent magnets manufactured from the TM—RE—B permanent magnetic materials, and most notably the TM—RE—B materials having predominantly the $RE_2TM_{14}B_1$ phase.

TM—RE—B alloys are disclosed in numerous patents. For example, Koon U.S. Pat. Nos. 4,374,665, 4,402,770, 4,409,043, and 4,533,408 disclose a magnetic alloy comprising (1) iron (a transition metal), (2) lanthanum and a lanthanide (rare earth metals) and (3) boron.

Croat U.S. Pat. Nos. 4,802,931 and 4,851,058 disclose predominantly single phase TM—RE—B alloys with the "2-14-1" phase (i.e., $RE_2TM_{14}B_1$) as the single phase. Croat U.S. Pat. No. 4,496,395 discloses a two component magnet material including a rare earth metal and a transition metal. Similarly, Brewer et al. U.S. Pat. No. 4,881,985 discloses a uniaxial TM—RE—B alloy comprising predominantly the $RE_2TM_{14}B_1$ phase.

Other patents disclosing TM—RE—B magnets include:

- Mizoguchi et al. U.S. Pat. No. 5,071,493, disclosing a two-phase permanent magnet comprising a sintered alloy having a magnetic $RE_2TM_{14}B_1$ phase and a non-magnetic phase that is rich in the rare earth metals;
- De Mooij et al. U.S. Pat. No. 4,935,074, disclosing a magnetic material comprising a transition metal, a rare earth metal and boron, wherein the rare earth metal is present in an amount of 4.8 atomic % or less, and the boron is present in an amount of 16 to 26 atomic %;
- Sagawa et al. U.S. Pat. No. 4,770,723, disclosing a magnetically anisotropic TM—RE—B magnetic material having a tetragonal crystal structure;
- Keem et al. U.S. Pat. Nos. 4,867,785 and 5,116,434, disclosing methods of manufacturing magnetic materials;
- Ovshinsky et al. U.S. Pat. Nos. 4,715,891 and 4,753,675, disclosing methods of preparing a magnetic material, such as a $RE_2TM_{14}B_1$ phase TM—RE—B alloy, either including or excluding modifiers, like silicon or aluminum; and
- European Patent Application 0 195 219, disclosing TM—RE—B alloys further including a silicon or aluminum modifier.

A permanent magnet composed of TM—RE—B contains particles of the alloy and comprise either 1) a magnetically aligned permanent magnet material, wherein the particles are referred to as aligned or anisotropic, or 2) a magnetically unaligned permanent magnet material, wherein the particles are referred to as unaligned or isotropic. A permanent magnet comprising aligned particles generally has a substantially greater magnetic strength than a magnet comprising unaligned particles. In a permanent magnet comprising aligned particles, the magnetic strength is directional. A substantial magnetic strength exists in the direction of alignment, whereas very little magnetic strength exists in directions transverse to the direction of alignment. In contrast, in a permanent magnet comprising unaligned particles, the magnetic strength is substantial in all directions, but the magnetic strength in any direction is generally considerably less than the magnetic strength in the direction of alignment in a magnet composed of aligned particles.

Accordingly, it would be desirable to provide an inexpensive, isotropic permanent magnet material that exhibits the magnetic properties of an expensive, aligned permanent magnet material. It also would be desirable to provide a permanent magnet material that is easy to magnetize (i.e., has a low coercivity, like ferrite), but retains a high degree of magnetization (i.e., has a high remanence, like a predominantly aligned TM—RE—B magnet material). A permanent magnet material having the combination of low coercivity and high remanence permits a permanent magnet composed of the material to be magnetized after the permanent magnet is positioned within a device.

SUMMARY OF THE INVENTION

The present invention is directed to a permanent magnet material including at least 10 weight % non-uniaxial material, and having sufficient magnetic properties for practical use in a permanent magnet. In particular, the permanent magnet material has the formula:

$$T_{(86.5-x-y)}RE_{(3.5+y)}B_{(10+x)},$$

wherein $-6.02 \leqq x \leqq 6.02$, and $-2.52 \leqq y \leqq 2.52$;or $$TM_{(96.5-q-r)}RE_{(1+q)}B_{(2.5+r)}$$

wherein $-1.48 \leqq r \leqq 1.48$ and $0 \leqq q \leqq 6.48-r$;
and wherein TM is a transition metal, RE is a rare earth metal, and B is boron or a combination of boron and carbon.

The permanent magnet material has a coercivity of greater than about 1,000 Oe and a remanence of greater than about 7,000 G (typically greater than about 9,000 G). The permanent magnetic material therefore is relatively easy to magnetize by an applied magnetic field, and also maintains excellent magnetic properties after the applied field is removed. The magnetic properties exhibited by a permanent magnet material of the present invention are of a magnitude which heretofore were attainable only with aligned magnet materials.

Because a permanent magnetic material of the present invention incorporates substantially less rare earth metal than prior TM—RE—B magnet materials, like $RE_2TM_{14}B_1$ magnet materials, the present permanent magnet material is less expensive than prior TM—RE—B materials, and accordingly is more suitable for the mass production of large quantities of low cost permanent magnets.

The present invention is also directed to a permanent magnet comprising the permanent magnetic material. In one embodiment, the permanent magnet is a bonded magnet, wherein the permanent magnetic material is admixed with a resin or a low-melting metallic alloy, and the resulting mixture is formed into a desired size and shape for the magnet. Because the permanent magnet material of the present invention is easily magnetized, the permanent magnet can be magnetized after the magnet is formed and positioned within a device.

The above and other aspects and advantages of the present invention will become apparent from the following detailed description of the present invention taken in conjunction with the drawings.

BRIEF DESCRIPTION OF THE DRAWINGS

FIG. 3 is a Reitveld powder profile analysis of a neutron diffraction scan, using neutrons of 1.5472 Angstroms, of a permanent magnet material of the present invention showing the presence of cubic α Fe (alpha iron).

DETAILED DESCRIPTION OF THE PREFERRED EMBODIMENTS

Figure 1:
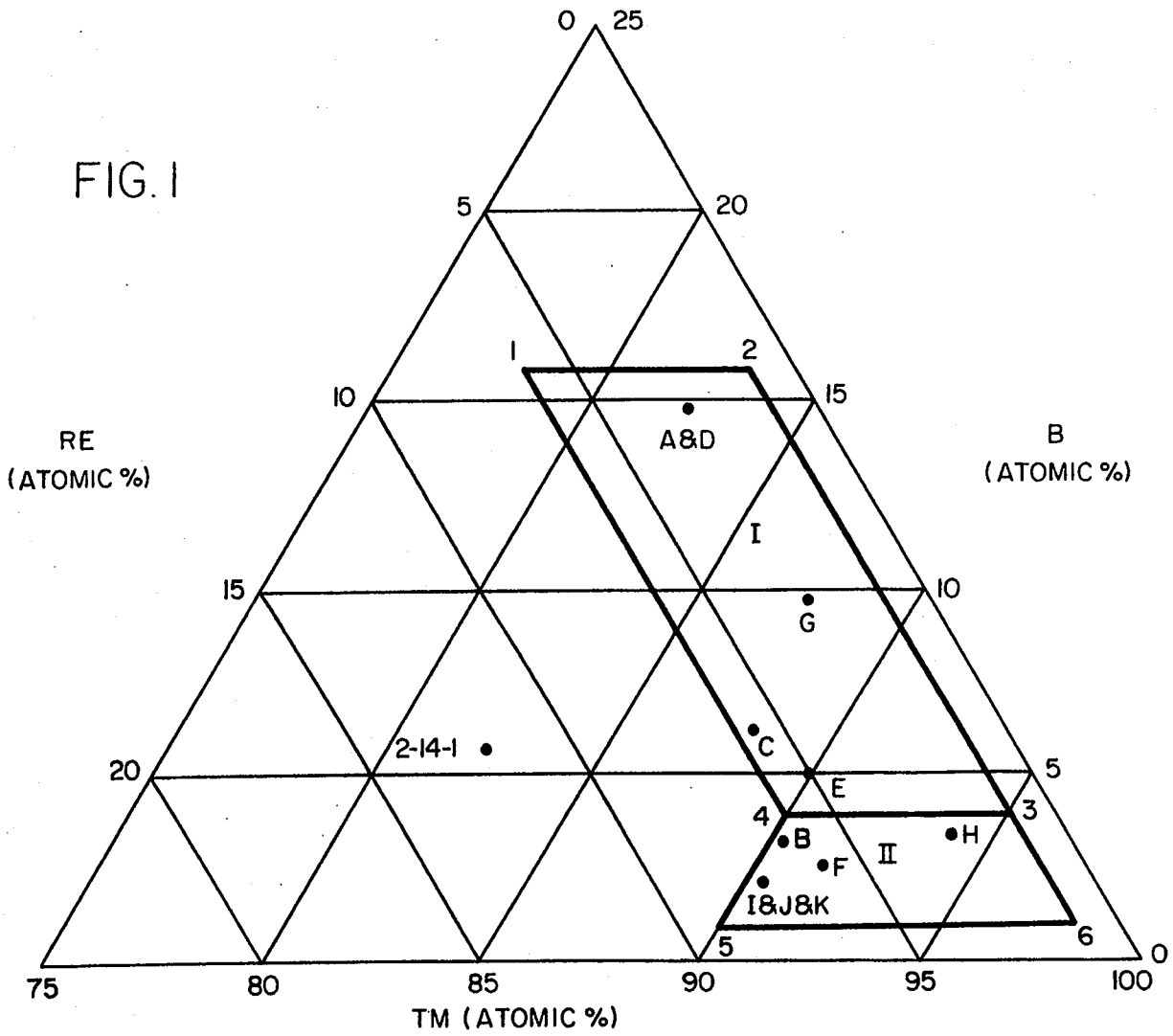
FIG. 1 is a partial ternary phase diagram illustrating the compositional makeup of the permanent magnet material of the present invention.

A permanent magnet material of the present invention comprises (a) a transition metal, (b) a rare earth metal, and (c) a boron component. Prior magnetic materials comprising these components either (1) had a uniaxial crystal structure characteristic of permanent magnet materials, or (2) had a non-uniaxial crystal structure including one or more soft rare earth phases and/or free iron phases, and did not possess sufficient magnetic properties for use in permanent magnets.

In contrast to these prior magnet materials, a permanent magnet material in accordance with the present invention includes at least 10 weight % non-uniaxial material, and has sufficient coercivity, remanence and maximum energy product for use in a permanent magnet.

A permanent magnet material of the present invention has the formula:

$$TM_{(86.5-x-y)}RE_{(3.5+y)}B_{(10+x)}, \quad (1)$$

wherein $-6.02 \leqq x \leqq 6.02$ and $-2.52 \leqq y \leqq 2.52$;or $$TM_{(96.5-q-r)}RE_{(1+q)}B_{(2.5+r)}, \quad (2)$$

wherein $-1.48 \leqq r \leqq 1.48$ and $0 \leqq q \leqq 6.48-r$; and wherein TM is a transition metal, RE is a rare earth metal, and B is a boron component including boron or a combination of boron and carbon. In formula 1 and formula 2, the subscripts (e.g., 86.5-x-y) denote the atomic % of a particular component in the permanent magnet material. The non-uniaxial material is included in the formula.

The transition metal (TM) comprises iron, cobalt or a mixture thereof. Preferably, the transition metal is iron. In addition, the transition metal component of the permanent magnet material can include titanium, vanadium, zirconium, tantalum, niobium, hafnium, chromium, nickel, manganese or a combination thereof, in an amount of up to about 10 atomic % and preferably up to about 5 atomic % of the total composition.

The rare earth metal (RE) is scandium, yttrium, an element having atomic number 57 (lanthanum) through 71 (lutetium), or any combination thereof. Preferably, the rare earth metal is a light rare earth metal, such as scandium, yttrium, lanthanum, cerium, praseodymium, neodymium, promethium, samarium, europium, gadolinium, or a combination thereof. To achieve the full advantage of the present invention, at least one-half of the atomic % of the rare earth metal present in the permanent magnet material is a light rare earth metal; the remainder of the rare earth metal is a heavy rare earth metal, such as terbium, dysprosium, holmium, erbium, thulium, ytterbium, lutetium, or a combination thereof.

Preferred light rare earth metals include neodymium, praseodymium, and combinations thereof. To achieve the full advantage of the present invention, the light rare earth metal is neodymium. Preferred heavy rare earth metals, used in conjunction with a light rare earth metal, are terbium, dysprosium, and combinations thereof.

The boron component (B) is either boron alone or a combination of boron and carbon. If the permanent magnet material includes a combination of boron and carbon, up to about three-fourths of the atomic % of the boron component can be carbon.

The compositional makeup of the permanent magnet material of the present invention is illustrated in FIG. 1, which is a partial ternary phase diagram illustrating the boundaries of the permanent magnet material. The particular permanent magnet material illustrated in FIG. 1 includes iron (Fe) as the transition metal (TM) component, neodymium (Nd) as the rare earth metal (RE) component, and boron as the (B) component.

Specifically, the points designated as 1, 2, 3 and 4 in FIG. 1 define zone I of the ternary phase diagram, and illustrate the permanent magnet materials of formula 1. The points designated as 3, 4, 5 and 6 in FIG. 1 define zone II of the ternary phase diagram, and illustrate the permanent magnet materials of formula 2. The permanent magnet materials of the present invention include alloys within zone I and zone II of FIG. 1, and other TM—RE—B alloys including at least 10% by weight non-uniaxial material and having a coercivity of at least about 1,000 Oe.

From FIG. 1, if the amount of rare earth metal (Nd) in the magnet material is greater than about 6 atomic %, and if the amount of boron, or boron and carbon, is less than about 10.5 atomic %, then an essentially single phase magnetic material having the atomic proportional formula $RE_2TM_{14}B_1$,i.e., the "2-14-1" phase, forms. (The corresponding atomic percentage formula is $TM_{82}RE_{12}B_6$.) This "2-14-1" phase material is disclosed in Croat U.S. Pat. No. 4,802,831. The idealized $RE_2TM_{14}B$ alloy is denoted in FIG. 1 as the point "2-14-1".

If the amount of boron in the magnet material is greater than about 16 atomic %, and the rare earth metal content is less than about 5 atomic %, the resulting alloy is essentially single phase and has the atomic proportional formula structure $Fe_3B$. This $Fe_3B$ alloy is disclosed in De Mooij et al. U.S. Pat. No. 4,935,074. If the amount of boron is greater than about 16 atomic %, but the amount of rare earth metal is greater than about 5 atomic %, the coercivity of the resulting magnetic material is less than 1,000 Oe, and therefore the magnetic material is unsuitable for use in a permanent magnet.

In the compositional range defined by formulas 1 and 2, and as illustrated in FIG. 1 as zones I and II, a permanent magnetic material of the present invention is a multiphase material including: 1) a conventional hard magnetic phase encompassed within the formula depicted in zones I or II, and 2) at least one soft magnetic phase comprising alpha iron; the permanent magnetic material includes at least 10 weight % non-uniaxial material (e.g., the alpha iron), but nevertheless has a coercivity of at least 1,000 Oe. The permanent magnet materials defined by zones I and II of FIG. 1 therefore are useful in permanent magnets.

Figure 2:
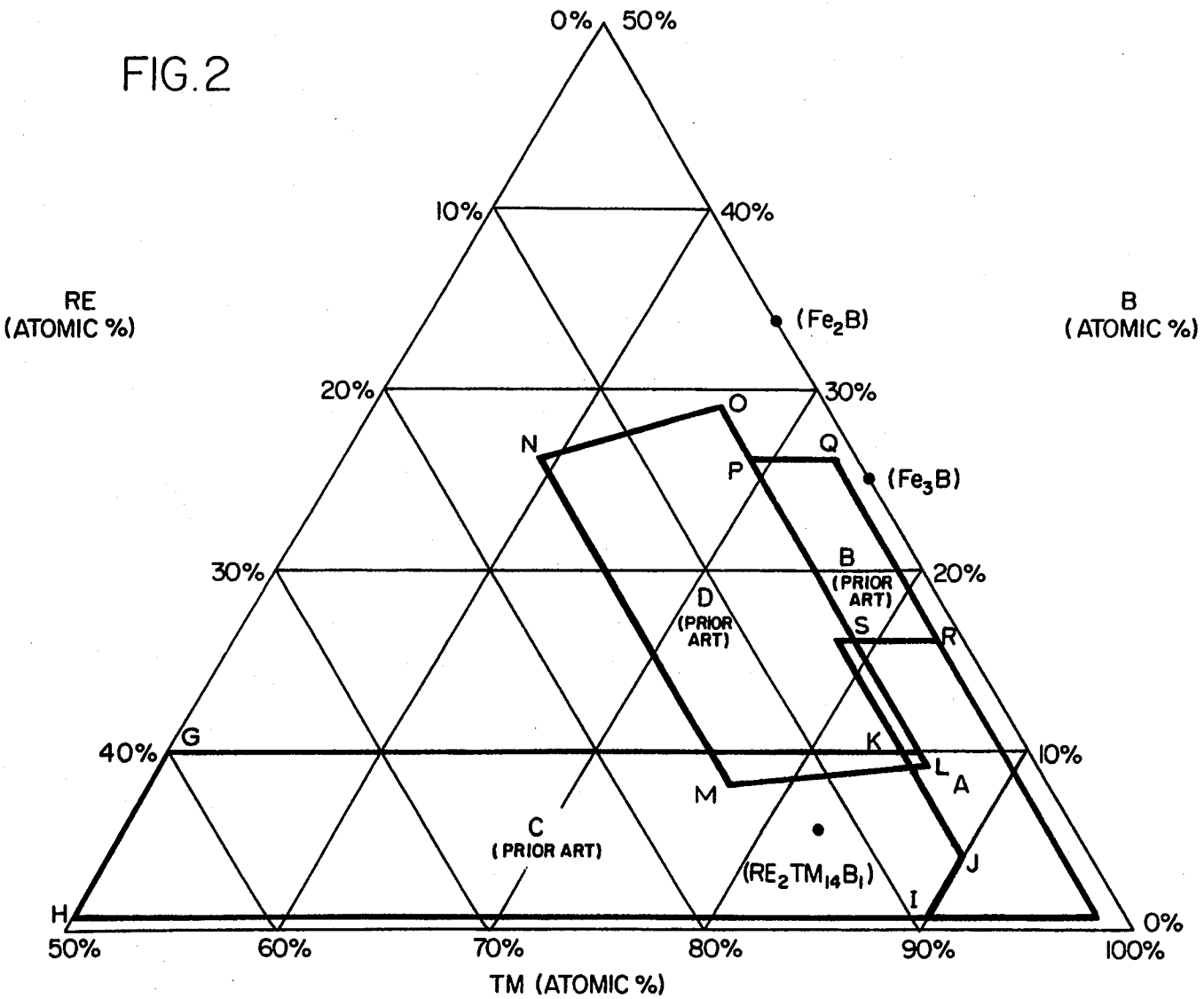
FIG. 2 is a partial ternary phase diagram illustrating the compositional makeup of the present permanent magnet material in comparison to prior TM—RE—B alloys.

The relationship between the compositional makeup of a permanent magnet material of the present invention and prior magnet materials is illustrated in the partial ternary phase diagram of FIG. 2. In FIG. 2, the permanent magnet materials of the present invention are depicted by zone A. The magnet materials disclosed in De Mooij et al. U.S. Pat. No. 4,935,074 are depicted by zone B which is the parallelogram defined by the points P, Q, R and S. The magnet materials disclosed in Croat U.S. Pat. No. 4,803,931 are depicted by zone C which is the polygon defined by the points G, H, I,J and K. The magnet materials disclosed in Koon U.S. Pat. No. 4,402,770 are depicted by zone D which is the quadrilateral defined by points L, M, N and O. As clearly illustrated in FIG. 2, the present permanent magnetic materials have a compositional makeup different from prior TM—RE—B magnet materials. As will be demonstrated more fully hereinafter, the present permanent magnet materials have unique magnetic properties making the present permanent magnetic materials useful in permanent magnets and in devices containing permanent magnets.

The permanent magnet materials of the present invention are made by standard techniques known to those skilled in the art. In an exemplary method, suitable amounts of a transition metal, rare earth metal and boron are first admixed, then melted under a protective gas, like argon. The resulting mixture of melted components is then rapidly cooled, such as by the melt spinning technique, and comminuted to form flakes of the permanent magnet material having a microcrystalline structure. Preferably, the flakes are then subjected to additional processing, like a heat treatment, to induce an acceptable microstructure. The methods used to form the permanent magnet materials are set forth in Keem et al. U.S. Pat. Nos. 4,867,785 and 5,116,434, Croat U.S. Pat. Nos. 4,802,931 and 4,851,058, Koon U.S. Pat. No. 4,402,770, and Brewer et al. U.S. Pat. No. 4,881,985, each incorporated herein by reference.

The heat treatment typically includes heating the permanent magnet material, e.g., to a temperature in the range of about 500° C. to about 900° C., for a time in the range of about 20 minutes to about one hour, for example, in a non-oxidizing atmosphere (i.e., in the absence of oxygen). Typically, the heat treatment is conducted at about 550° C. to about 750° C. in a flowing argon atmosphere. The optimal time and temperature of the heat treatment for each permanent magnet material can be determined by a person skilled in the art through simple experimentation.

To demonstrate the permanent magnet materials of the present invention, the following Examples A–G were prepared by the above-described method. Each permanent magnet material was heat-treated in a non-oxidizing atmosphere prior to testing the material for magnetic properties. The compositional makeup and the magnetic properties of the permanent magnet materials of Examples A–K are set forth below in Table I. The compositional makeup of each permanent magnet material of Examples A–K is illustrated in the partial ternary phase diagram of FIG. 1 as points labeled A through K, respectively.

The permanent magnet materials of Examples A–K were magnetized by applying a magnetic field of at least about 25 kOe (kiloOersteds). The intrinsic coercive force (i.e., coercivity) is determined by reversing the magnetic field and determining the reverse field required to reduce the magnetization to zero.

TABLE I

Magnetic Properties of Permanent Magnet Materials

| Example | RE(%) | TM(%) | B(%) | $BH_{max}$[1] (MGOe) | $H_{ci}$[2] (Oe) | $B_r$[3] (G) | T[4] (°C.) | t[4] (hr) |
|---|---|---|---|---|---|---|---|---|
| A | Nd[5](2.91)[6] | Fe(82.30) | B(14.78) | 6.58 | 1,807 | 10,930 | 660 | 1 |
| B | Nd(6.60) | Fe(89.60) Nb(1.00) | B(3.34) | 8.88 | 3,467 | 9,348 | 720 | 1 |
| C | Nd(5.55) | Fe(88.06) Nb(1.00) | B(5.99) | 9.31 | 4,102 | 9,050 | 660 | 1 |
| D | Nd(2.85) | Fe(80.67) Nb(2.00) | B(14.48) | 9.53 | 2,393 | 11,060 | 660 | 1 |
| E | Nd(4.08) Dy(1.00) | Fe(90.15) | B(5.11) | 8.39 | 3,076 | 10,050 | 660 | 0.42 |
| F | Nd(3.91) Tb(2.00) | Fe(91.32) | B(2.66) | 7.35 | 3,271 | 9,265 | 720 | 1 |
| G | Nd(2.84) | Fe(85.66) Nb(2.00) | B(9.50) | 4.27 | 1,025 | 10,300 | 660 | 1 |
| H | Nd(2.89) | Fe(91.88) Nb(2.00) | B(3.23) | 6.83 | 1,611 | 12,000 | — | — |
| I | Nd(7.01) | Fe(88.48) Zr(2.00) | B(2.39) | 3.38 | 2,148 | 7,041 | — | — |
| J | Nd(7.01) | Fe(88.48) Ti(2.00) | B(2.39) | 4.83 | 1,807 | 8,842 | — | — |
| K | Nd(7.01) | Fe(88.48) V(2.00) | B(2.39) | 4.64 | 2,197 | 8,084 | — | — |

[1] $BH_{max}$ is magnetic energy product in megaGaussOersteds (MGOe);
[2] $H_{ci}$ intrinsic coercivity in Oersteds (Oe);
[3] $B_r$ remanence in Gauss (G);
[4] T and t are temperature and time, respectively, of the heat treatment prior to testing for the magnetic properties, all magnet materials of Examples A–K were heat treated;
[5] Abbreviations of elements: Nd-neodymium, Dy-dysprosium, Th-terbium, Fe-iron, Nb-niobium, and B-boron; and
[6] Amount of an element present in the permanent magnet material expressed as atomic & (the total atomic % is not precisely 100% due to limits of experimental accuracy).

The unique magnetic properties of the present permanent magnet materials are demonstrated by comparing the magnetic properties of the permanent magnet materials of Examples A–K (1) to the commonly-used ferrite materials and (2) to the TM—RE—B magnet materials disclosed in Croat U.S. Pat. No. 4,802,831 (i.e., $RE_2TM_{14}B_1$). The ferrites are very inexpensive magnetic materials that possess poorer magnetic properties than TM—RE—B magnet materials. Ferrites are anisotropic materials having a coercivity of up to about 4,000 Oe, typically about 2,000 to about 4,000 Oe. Magnet materials having a coercivity of at least about 1,000 Oe are considered permanent magnet materials. The TM—RE—B magnet materials disclosed in Croat U.S. Pat. No. 4,802,831, and having predominantly a single phase, $RE_2TM_{14}B_1$, exhibit a coercivity of about 10,000 Oe. There are many practical applications in which a magnet material having a coercivity of about 10,000 Oe cannot be used because it cannot be magnetized.

Ferrites exhibit a coercivity of about 2,000 to about 4,000 Oe and are easy to magnetize. Ferrites, however, also exhibit a remanence of about 2,000 to about 4,000 Gauss, and therefore cannot be used in practical applications requiring a high remanence. In comparison, the remanence of the $RE_2TM_{14}B_1$ magnet materials (Croat U.S. Pat. No. 4,802,831) is about 8,000 Gauss. Presently, the remanences demonstrated by these $RE_2TM_{14}B_1$ magnet materials are considered the state of the art.

From the data summarized in Table I, the permanent magnet materials of Examples A through K exhibit an intrinsic coercivity ($H_{ci}$) of about 1,000 to greater than 4,000 Oe. A coercivity in this range is sufficient for a permanent magnet material and essentially matches the coercivity of ferrites. Therefore, a permanent magnet material of the present invention can be magnetized easily compared to a $RE_2TM_{14}B_1$ magnet material, which exhibits an intrinsic coercivity of about 10,000 Oe.

The data in Table I also illustrate that the permanent magnet materials of Examples A–K exhibit a remanence of about 7,000 to about 12,000 Gauss. Typically, the remanence of a permanent magnet material of the present invention is greater than 9,000 G. A remanence in this range is well above the remanence exhibited by ferrites (e.g., about 2,000 to about 4,000 G), and surpasses the remanence exhibited by present day commercial $RE_2TM_{14}B_1$ magnet materials (e.g., about 8,000 G).

The present permanent magnet materials therefore exhibit a unique combination of magnetic properties including a low coercivity and a high remanence. The permanent magnet materials are magnetized as easily as ferrites, but also maintain a degree of magnetization after the applied field is removed that exceeds present day state of the art magnet materials.

The data summarized in Table I also illustrate that the permanent magnetic materials tabulated there possess an excellent maximum magnetic energy product ($BH_{max}$). The $RE_2TM_{14}B_1$ magnet materials exhibit a $BH_{max}$ of about 10 to about 12 MGOe. The highest theoretical $BH_{max}$ for unaligned materials is 16 MGOe. Anisotropic ferrites typically exhibit a $BH_{max}$ of about 4 MGOe. A $BH_{max}$ of about 9 MGOe is considered excellent by those skilled in the art. As illustrated in Table I, the permanent magnet materials of Examples A–K exhibit a $BH_{max}$ of about 3.4 to about 9.5 MGOe. The permanent magnet materials of the present invention typically exhibit a $BH_{max}$ greater than 4 MGOe. The present permanent magnet materials therefore exhibit a maximum magnetic energy product that is improved over the maximum magnetic energy product of the ferrites.

The present permanent magnet materials exhibit a lower $BH_{max}$ than the $RE_2TM_{14}B_1$ magnet materials. However, the $RE_2TM_{14}B_1$ magnet materials include approximately 12 atomic % of a rare earth metal. The present permanent magnet materials include a maximum of about 9 atomic % of a rare earth metal, and typically less than 5 atomic % of a rare earth metal. The present permanent magnet materials therefore are considerably less expensive than the $RE_2TM_{14}B_1$ magnetic materials, and compare favorably in cost to the ferrites.

Accordingly, a permanent magnet material of the present invention exhibits substantially improved magnetic properties compared to the ferrites, and is inexpensive.

Another permanent magnet material, Example L, was also prepared. The permanent magnet material of Example L includes 6.14 atomic % neodymium, 3 atomic % niobium, 85.02 atomic % iron and 5.62 atomic % boron. Example L was prepared in an essentially identical manner to that used for Examples A–K. After heat treatment, the permanent magnet material of Example L exhibited an energy product ($BH_{max}$) of 10.11 MGOe, an intrinsic coercivity ($H_{ci}$) of 4,785 Oe, and a remanence of 9,472 G.

The permanent magnet material of Example L also was tested for the presence of cubic $\alpha$ iron by neutron diffraction. The neutron diffraction scan of the permanent magnet material of Example L is illustrated in FIG. 3 demonstrating that the permanent magnet material of Example L is predominantly non-uniaxial material. The presence of such significant amounts of cubic $\alpha$ iron shows that a permanent magnet material of the present invention is a multiphase material and includes at least 10 weight and typically at least 40 weight %, non-uniaxial materials. It is both surprising and unexpected for a permanent magnet material of the present invention, which includes such a large weight percent of non-uniaxial materials, to demonstrate permanent magnet properties.

A permanent magnet material of the present invention can be admixed with a polymeric resin or a low melting metal alloy, such as a metal alloy having a melting point of about 700° C. or less. The resulting mixture then can be molded into a resin-bonded magnet or into a metal magnet. The resulting permanent magnets possess sufficient magnetic properties to outperform ferrite magnets and are cost competitive with ferrite magnets.

A permanent magnet material of the present invention therefore provides a relatively inexpensive and relatively high performance permanent magnet. The permanent magnet exhibits sufficiently high magnetic properties to outperform conventional ferrite magnets. Unexpectedly, the permanent magnet also demonstrates an improved remanence over permanent magnets comprising prior TM—RE—B magnetic materials, like $RE_2TM_{14}B_1$.

Obviously, many modifications and variations of the invention as hereinbefore set forth can be made without departing from the spirit and scope thereof and therefore only such limitations should be imposed as are indicated by the appended claims.

We claim:

1. A permanent magnet material comprising a transition metal, a rare earth metal and a boron component, said magnet material including at least 10 weight percent of a material having more than one easy axis of magnetization and having a coercivity of at least about 1,000 Oersteds, said magnet material having the formula, in atomic %:

$$TM_{(84.3-w-z)}RE_{(3.0+w)}B_{(12.7+z)},$$

wherein $-3.3 \leqq z < 3.3$ and $-2.0 \leqq w < 2.0$; or $$TM_{(89.8-x-y)}RE_{(3.5+y)}B_{(6.7+x)},$$

wherein $-2.5 \leqq y < 2.5$ and $-2.7 \leqq x \leqq 2.7$; or $$TM_{(96.5-q-r)}RE_{(1+q)}B_{(2.5+r)},$$

wherein $-1.5 \leqq r \leqq 1.5$ and $0 \leqq q < 6.5-r$,
wherein TM is a transition metal; RE is a rare earth metal; and B is boron or a combination of boron and carbon.

2. The permanent magnet material of claim 1 including at least 40 weight percent of a material having more than one easy axis of magnetization.

3. The permanent magnet material of claim 1 having a remanence of at least about 7,000 Gauss.

4. The permanent magnet material of claim 1 having a remanence of at least about 9,000 Gauss.

5. The permanent magnet material of claim 1 having a remanence of at least about 11,000 Gauss.

6. A permanent magnet material comprising a transition metal, a rare earth metal and a boron component, and having the formula, in atomic %:

$$TM_{(84.3-w-z)}R_{E(3.0+w)}B_{(12.7+z)},$$

wherein $-3.3 \leqq z < 3.3$ and $-2.0 \leqq w < 2.0$; or $$TM_{(89.8-x-y)}RE_{(3.5+y)}B_{(6.7+x)},$$

wherein $-2.5\ y < 2.5$ and $-2.7 \leqq x \leqq 2.7$; or $$TM_{(96.5-q-r)}RE_{(1+q)}B_{(2.5+r)},$$

wherein $-1.5r \leqq 1.5$ and $0 \leqq q < 6.5-r$,
and wherein TM is a transition metal comprising iron, cobalt, or mixtures thereof; RE is a rare earth metal; and B is boron or a combination of boron and carbon, said magnet material having at least 10 weight percent of a material having more than one easy axis of magnetization.

7. The permanent magnet material of claim 6 including at least 40 weight percent of a material having more than one easy axis of magnetization.

8. The permanent magnet material of claim 6 wherein up to about 10 atomic % of the permanent magnet material is a transition metal selected from the group consisting of titanium, vanadium, zirconium, tantalum, niobium, hafnium, chromium, nickel, manganese, and combinations thereof.

9. The permanent magnet material of claim 6 wherein up to about 5 atomic % of the permanent magnet material is a transition metal selected from the group consisting of titanium, vanadium, zirconium, tantalum, niobium, hafnium, chromium, nickel, manganese, and combinations thereof.

10. The permanent magnet material claim 9 further comprising a heavy rare earth metal selected from the group consisting of terbium, dysprosium, holmium, erbium, thulium, ytterbium, lutetium, and combinations thereof.

11. The permanent magnet material of claim 6 wherein at least about one-half of the atomic % of the rare earth metal is light rare earth metal selected from the group consisting of scandium, yttrium, cerium, praseodymium, lanthanum, and combinations thereof.

12. The permanent magnet material of claim 11 wherein the light rare earth metal is neodymium, praseodymium or a combination thereof.

13. The permanent magnet material of claim 6 wherein B is a combination of boron and carbon, said combination of boron and carbon including up to about three-fourths of the atomic % of B as carbon.

14. The permanent magnet material of claim 6 wherein the rare earth metal is (a) neodymium, and (b) 0 to about 2 atomic % of dysprosium, terbium or a combination thereof.

15. The permanent magnet material of claim 6 wherein the transition metal is (a) iron, and (b) 0 to about 5 atomic % of niobium.

16. The permanent magnet material of claim 6 having a coercivity of at least about 1,000 Oersteds.

17. The permanent magnet material of claim 16 having a remanence of at least about 7,000 Gauss.

18. The permanent magnet material of claim 16 having a remanence of at least about 9,000 Gauss.

19. The permanent magnet material of claim 16 having a remanence of at least about 11,000 Gauss.

20. A magnet material comprising (1) a transition metal, (2) a rare earth metal, and (3) boron and having a composition within either zone I or zone II in FIG. 1, said magnet material further having a composition within one of the following ranges the formula, in atomic %:

$$TM_{(84.3-w-z)}RE_{(3.0+w)}B_{(12.7+z)},$$

wherein $-3.3 \leqq z < 3.3$ and $-2.0 \leqq w < 2.0$; or $$TM_{(89.8-x-y)}RE_{(3.5+y)}B_{(6.7+x)},$$

wherein $-2.5 \leqq y < 2.5$ and $-2.7 \leqq x \leqq 2.7$; or $$TM_{(96.5-q-r)}RE_{(1+q)}B_{(2.5+r)},$$

wherein $-1.5 \leqq r \leqq 1.5$ and $0 \leqq q < 6.5-r$, wherein TM is a transition metal; RE is a rare earth metal; and B is boron or a combination of boron and carbon, and said magnet material having at least 10 weight percent of a material having more than one easy axis of magnetization.

21. The magnet material of claim 20 wherein the transition metal is iron and the rare earth metal is neodymium.

22. The magnet material of claim 20 wherein the transitional metal is (a) iron, and (b) 0 to about 5 atomic % niobium.

23. The magnet material of claim 20 wherein the rare earth metal is (a) neodymium, and (b) 0 to about 2 atomic % of dysprosium, niobium, or a combination thereof.

24. The magnet material of claim 20 wherein B is a combination of boron and carbon.

25. The magnet material of claim 20 including at least 40 weight percent of a material having more than one easy axis of magnetization.

26. The magnet material of claim 20 having a coercivity of at least about 1,000 Oersteds.

27. The magnet material of claim 26 having a remanence of at least about 7,000 Gauss.

28. The magnet material of claim 26 having a remanence of at least about 9,000 Gauss.

29. The magnet material of claim 26 having a remanence of at least about 11,000 Gauss.

30. A permanent magnet comprising the magnet material of claim 20.

31. A permanent magnet comprising a magnet material having the formula, in atomic %:

$$TM_{(84.3-w-z)}RE_{(3.0+w)}B_{(12.7+z)},$$

wherein $-3.3 \leqq z < 3.3$ and $-2.0 \leqq w < 2.0$; or $$TM_{(89.8-x-y)}RE_{(3.5+y)}B_{(6.7+x)},$$

wherein $-2.5 \leqq y < 2.5$ and $-2.7 \leqq x \leqq 2.7$; or $$TM_{(96.5-q-r)}RE_{(1+q)}B_{(2.5+r)},$$

wherein $-1.5 \leqq r \leqq 1.5$ and $0 \leqq q < 6.5-r$, and wherein TM is a transition metal comprising iron, cobalt, or mixtures thereof; RE is a rare earth metal; and B is boron or a combination of boron and carbon, wherein the magnet material comprises at least 10 weight percent of a material having more than one easy axis of magnetization.

32. The magnet of claim 31 further comprising a polymeric resin, a low melting metal body alloy or a combination thereof.

33. The magnet material of claim 31 wherein the magnet material includes at least 40 weight percent of a material having more than one easy axis of magnetization.

34. The magnet of claim 31 having a coercivity of at least 1,000 Oersteds.

35. The magnet of claim 31 having a remanence of at least about 7,000 Gauss.

36. The magnet of claim 31 having a remanence of at least about 9,000 Gauss.

37. The magnet of claim 31 having a remanence of at least about 11,000 Gauss.

38. A permanent magnet material comprising a transition metal, a rare earth metal and a boron component, said magnet material including at least 10 weight percent of a material having more than one easy axis of magnetization and having a coercivity of at least about 1,000 Oersteds, said magnet material having the formula, in atomic %:

$$TM_{(84.3-w-z)}RE_{(3.0+w)}B_{(12.7+z)},$$

wherein $-3.3 \leqq z < 3.3$ and $-2.0 \leqq w < 2.0$, and wherein TM is a transition metal comprising iron, cobalt, or mixtures thereof; RE is a rare earth metal; and B is boron or a combination of boron and carbon.

39. A permanent magnet material comprising a transition metal, a rare earth metal and a boron component, said magnet material including at least 10 weight percent of a material having more than one easy axis of magnetization and having a coercivity of at least about 1,000 Oersteds, said magnet material having the formula, in atomic %:

$$TM_{(89.8-x-y)}RE_{(3.5+y)}B_{(6.7+x)},$$

wherein $-2.5 \leqq y < 2.5$ and $-2.7 \leqq x \leqq 2.7$, and wherein TM is a transition metal comprising iron, cobalt, or mixtures thereof; RE is a rare earth metal; and B is boron or a combination of boron and carbon.

40. A permanent magnet material comprising a transition metal, a rare earth metal and a boron component, said magnet material including at least 10 weight percent of a material having more than one easy axis of magnetization and having a coercivity of at least about 1,000 Oersteds, said magnet material having the formula, in atomic %:

$$TM_{(96.5-q-r)}RE_{(1+q)}B_{(2.5+r)},$$

wherein $-1.5 \leqq r \leqq 1.5$ and $0 \leqq q < 6.5-r$, and wherein TM is a transition metal comprising iron, cobalt, or mixtures thereof; RE is a rare earth metal; and B is boron or a combination of boron and carbon.

41. A magnet material comprising (1) a transition metal, (2) a rare earth metal, and (3) boron and having a composition within zone I in FIG. 1, but excluding magnet materials wherein the transition metal is present in an amount of 78 to 85.5 atomic %, the rare earth is present in an amount of 5 to 6 atomic % and the boron is present in an amount of 9.4 to 16 atomic %, said magnet material comprising at least 10 weight percent of a material having more than one easy axis of magnetization.

42. A magnet material comprising (1) a transition metal, (2) a rare earth metal, and (3) boron and having a composition within zone II in FIG. 1, said magnet material comprising at least 10 weight percent of a material having more than one easy axis of magnetization.

* * * * *

UNITED STATES PATENT AND TRADEMARK OFFICE

CERTIFICATE OF CORRECTION

PATENT NO. : 5,403,408

DATED : April 4, 1995

INVENTOR(S) : KRAUSE ET AL.

It is certified that error appears in the above-identified patent and that said Letters Patent is hereby corrected as shown below:

Title page, item [57], Abstract, line 12, "least weight" should be --least 10 weight--.

Column 1, line 42, "(TM) rare" should be --(TM)-rare--.

Column 4, line 22, "$T_{(8\ 6.5-x-y)}$" should be --$TM_{(86.5-x-y)}$--.

Column 7, line 4, "B which is" should be --B, which is--.

Column 7, line 6, "C which is" should be --C, which is--.

Column 7, line 9, "D which is" should be --D, which is--.

Column 8, line 50, "Th-terbium" should be --Tb-terbium--.

Column 8, line 52, "as atomic &" should be --as atomic %--.

Column 10, line 23, "10 weight and" should be --10 weight %, and--.

Column 11, line 19, "...$R_{E(3.0+w)}$..." should be --...$RE_{(3.0+w)}$...--.

Column 11, line 24, "-2.5 y<2.5" should be -- $-2.5 \leq y < 2.5$--.

Column 11, line 28, "$-1.5r \leq 1.5$" should be -- $-1.5 \leq r \leq 1.5$--.

Column 12, line 18, "ranges the formula," should be --ranges,--.

UNITED STATES PATENT AND TRADEMARK OFFICE

CERTIFICATE OF CORRECTION

PATENT NO. : 5,403,408

DATED : April 4, 1995

INVENTOR(S) : KRAUSE ET AL.

It is certified that error appears in the above-identified patent and that said Letters Patent is hereby corrected as shown below:

Column 13, line 14, "metal body alloy" should be --metal alloy--.

Column 11, lines 58-59, "praseodymium, lanthanum," should be --praseodymium, neodymium, promethium, samarium, europium, gadolinium, lanthanum,--.

Signed and Sealed this

Nineteenth Day of December, 1995

*Attest:*

*Attesting Officer*

Bruce Lehman

BRUCE LEHMAN

*Commissioner of Patents and Trademarks*